US009228300B2

(12) United States Patent
Scattergood

(10) Patent No.: US 9,228,300 B2
(45) Date of Patent: Jan. 5, 2016

(54) SLIPFORMING ASSEMBLY

(71) Applicant: Brian Scattergood, St Helens Park (AU)

(72) Inventor: Brian Scattergood, St Helens Park (AU)

( * ) Notice: Subject to any disclaimer, the term of this patent is extended or adjusted under 35 U.S.C. 154(b) by 0 days.

(21) Appl. No.: 14/274,221

(22) Filed: May 29, 2014

(65) Prior Publication Data

US 2015/0322633 A1 Nov. 12, 2015

(30) Foreign Application Priority Data

May 8, 2014 (AU) ..... 2014202502

(51) Int. Cl.
*E01C 19/48* (2006.01)

(52) U.S. Cl.
CPC ..... *E01C 19/4886* (2013.01); *E01C 19/48* (2013.01)

(58) Field of Classification Search
CPC ..... E01C 19/48; E01C 19/4886
USPC ..... 404/2, 4, 89, 98, 84.1, 105, 108, 118; 405/175, 179; 37/142.5
See application file for complete search history.

(56) References Cited

U.S. PATENT DOCUMENTS

| | | | | | |
|---|---|---|---|---|---|
| 2,987,891 | A * | 6/1961 | Phillips | 405/283 |
| 3,123,883 | A * | 3/1964 | Peirsol et al. | 425/59 |
| 3,540,226 | A * | 11/1970 | Sherrod | 405/164 |
| 3,779,661 | A | 12/1973 | Godbersen | |
| 3,959,977 | A * | 6/1976 | Godbersen | 405/155 |
| 5,765,966 | A * | 6/1998 | White et al. | 405/174 |
| 5,911,544 | A * | 6/1999 | Mahony | 405/271 |
| 5,938,373 | A * | 8/1999 | Scudder | 405/179 |
| 6,109,825 | A | 8/2000 | Yon | |
| 7,186,059 | B2 * | 3/2007 | Barnes | 405/175 |
| 8,596,914 | B2 * | 12/2013 | Baber | 405/179 |
| 2002/0064427 | A1 * | 5/2002 | Bond | 405/179 |
| 2010/0008718 | A1 | 1/2010 | Cooper | |
| 2012/0128417 | A1 | 5/2012 | Zimmermann et al. | |

FOREIGN PATENT DOCUMENTS

WO WO 2005083180 * 2/2005 ..... E01C 19/48

OTHER PUBLICATIONS

Wirtgen Group, "Concrete Slipform Paving Manual (Wirtgen)", 2009, 228 pages, English version retrieved from <http://www.wirtgen.de/en/technologies/slipform-paving/hands-manuals/manual.php> on Nov. 2, 2015, Wirtgen GmbH, Germany.

(Continued)

*Primary Examiner* — Raymond W Addie
(74) *Attorney, Agent, or Firm* — Alston & Bird LLP

(57) ABSTRACT

Various embodiments of the present invention relate to an assembly and method for slipforming a slot drain with concrete. The assembly includes a slipform paver, a movable sleeve adapted to fit over a void forming means, a first taut tether, sensing means and one or more actuators. The first taut tether is provided and maintained in an inclined or declined disposition to provide a parallel reference for guiding the sleeve which in use is driven forward by the slipform paver. The sensing means are adapted to receive guidance from the inclined or declined tether for dictating the elevations and dispositions of the sleeve. The one or more actuators are connected to the sleeve and adapted to be controlled by the sensing means to achieve the dictated elevations and dispositions of the sleeve.

31 Claims, 9 Drawing Sheets

(56) References Cited

OTHER PUBLICATIONS

Concrete Construction Staff, "Slipforming a Slot Drain", *Concrete Construction*; Apr. 1998, 3 pages, retrieved from <http://www.google.com/url?sa=t&rct=j&q=&esrc=s&source=web&cd=1&ved=0CB0QFjAAahUKEwjG89yohfLI AhVKNSYKHfrtCvQ&url=http%3A%2F%2Fwww.concreteconstruction.net%2Fimages%2Fslipforming%2520a%2520slot%2520drain_tcm45-356822.pdf&usg=AFQjCNE6 vEthIrf0KfIKUMZ94136Jy7JWw&bvm=bv.106379543,d.eWE> on Nov. 2, 2015, The Aberdeen Group, U.S.A.

Intellectual Property Office, First Examination Report for Application No. 624818, May 28, 2014, 2 pages, New Zealand.

Australian Government, IP Australia, Patent Examination Report No. 1 for Application No. 2014203253, Nov. 10, 2015, 4 pages, Australia.

* cited by examiner

SLIPFORMING ASSEMBLY

CROSS-REFERENCE TO RELATED APPLICATIONS

This application claims priority to and the benefit of Australian Patent Application Serial No. 2014202502, filed May 8, 2014, the contents of which are hereby incorporated by reference in their entirety.

BACKGROUND

1. Related Field

The present invention broadly relates to a slipforming assembly and method. In particular, this invention is concerned with an assembly and method for slipforming a slot drain.

2. Description of Related Art

Slot drains are generally desired on superelevations across dual carriage motorways where there is a centre barrier, as rain water will flow towards and fall into the slots. Conventional slot drains are created by horizontal slipforming which involves concrete being laid down, vibrated, worked, and settled in place while the form itself slowly moves forward.

As for prior art slot drains, referring to FIGS. 1 and 2, they typically have a shortcoming in not having any self-cleaning capability. As a result, dirt, leaves etc. get built up gradually in the drains leading to blockage and hence flooding on the motorways.

It is an object of the present invention to provide a slipforming assembly and method which may ameliorate the above shortcoming or which may at least provide the public with a useful alternative.

BRIEF SUMMARY

Accordingly, in one aspect, the present invention provides an assembly for slipforming a slot drain with concrete, the assembly including: a slipform paver; a movable sleeve adapted to fit over a void forming means; a first taut tether provided and maintained in an inclined or declined disposition to provide a parallel reference for guiding the sleeve which in use is driven forward by the slipform paver; sensing means adapted to receive guidance from the inclined or declined tether for dictating the elevations and dispositions of the sleeve; and one or more actuators connected to the sleeve and adapted to be controlled by the sensing means to achieve the dictated elevations and dispositions of the sleeve.

In certain embodiments, the assembly includes a slipforming mould adapted to be driven forward by the slipform paver.

In an exemplary embodiment, the sleeve includes a cylindrical pipe. In one embodiment, the pipe is made of metal. In these and other embodiments, the pipe has a chamfered end configured to reduce concrete load on the cylindrical pipe during dispensing of the concrete.

In one embodiment the tether includes a stringline held in place by a system of stakes and fastening means.

According to various embodiments, there are first and second actuators, the first actuator being associated with a first end of the pipe, the second actuator being associated with a second end of the pipe. In certain embodiments the first actuator is adapted to actuate a first connecting means which is affixed to the first end of the pipe. In one embodiment the second actuator is adapted to actuate a second connecting means which is affixed to the second end of the pipe. In another embodiment the first and second connecting means are in the form of plates. Each of the first and second actuators is a hydraulic ram. In these and other embodiments the plates may be disposed perpendicular to one another. In still other embodiments, the plates are connected to or form part of the slipforming mould.

According to various embodiments, the sensing means include first and second sensing wands, each adapted to ride beneath the stringline to receive guidance. In certain embodiments, the first and second sensing wands are in electronic communication with a control means. In these and still other embodiments, the first and second wands are capable of feeding signals to the control means via an amplifier to operate the first and second actuators, respectively.

According to various embodiments, the first and second actuators are synchronised to place and maintain the forward moving cylindrical pipe in the inclined or declined disposition at a selected angle. As such, after slipforming, the slot drain ends up with a change of fall or rise from pit to pit.

According to various embodiments, the slipforming mould includes form guiding means adapted to define an upper portion of the slot drain. In certain embodiments, an uppermost surface of the upper portion forms a longitudinally level road surface. In one embodiment, the form guiding means are in the form of a pair of substantially L-shaped elongate brackets. Conveniently, each of the pair of L-shaped brackets includes first and second limbs. It is desirable that each first limb is transversely slanted so as to form the uppermost surface capable of directing water flows towards the slipformed slot. In other embodiments, each second limb is substantially vertically placed.

According to various embodiments, the assembly includes means adapted to allow the form guiding means to be adjustably placed at a desired level. The means comprise a pair of longitudinally elongate legs, each leg having a foot. In certain embodiments, each leg is extendably connected to the corresponding second limb of each L-shaped bracket. As such, the form guiding means may be adjusted to a higher level when the leg is moved to an extended position. In other embodiments, each leg is configured to be inwardly inclined so as to prevent excess concrete from escaping during slipforming. In any of these and still other embodiments, the foot of each leg is adapted in use to rest on a base alongside the trench.

According to various embodiments, the assembly includes a pair of activators adapted to allow manual control of each longitudinally elongate leg. In certain embodiments, the activators are provided towards the opposite ends of the longitudinally elongate leg.

According to various embodiments, the assembly includes a second taut tether adapted to be provided and maintained in a level disposition to provide a parallel reference for controlling the steering and elevation of the slipform paver as it moves forward.

It is desirable that the void forming means is a deflatable tube being sealed at one end. During preparation, the tube with the sealed end is laid in an excavated trench in a deflated state, fed through the sleeve and then inflated.

According to various embodiments, the slipforming mould is driven by the slipform paver to move forward 5 along a length of the excavated trench.

According to various embodiments, the slipform paver includes an auger and one or more vibrators.

In certain embodiments, air-entrained concrete is delivered from a truck mixer to the slipforming mould via an auger mounted on the slipform paver. The concrete is in certain embodiments filled through the top of a hopper and dispensed through the bottom of the hopper into the slipforming mould.

According to various embodiments, the auger is in the form of a screw-type device used to transfer the concrete into the slipforming mould. In certain embodiments, each or the vibrator is configured to agitate the concrete so that it properly fills the slipforming mould and to 15 consolidate the agitated concrete.

According to various embodiments, the present invention provides a method of slipforming a slot drain with concrete, the method including the steps of: providing a slipform paver; fitting a movable sleeve over a void forming means; providing and maintaining a first taut tether in an inclined or declined disposition to provide a parallel reference for guiding the sleeve which in use is driven forward by the slipform paver; providing sensing means adapted to receive guidance from the inclined or declined first tether for dictating the elevations and dispositions of the sleeve; and providing one or more actuators connected to the sleeve and adapted to be controlled by the sensing means to achieve the dictated elevations and dispositions of the sleeve.

According to various embodiments, the method includes the step of moving the slipform paver thereby causing the sleeve to move accordingly at a selected angle of inclination or declination along an excavated trench whilst the concrete is dispensed from a slipforming mould.

According to various embodiments, the method includes the step of running the slipform paver from pit to pit 5 resulting in the slot drain having a changing fall or rise from pit to pit.

According to various embodiments, the method comprises the steps of letting the concrete set and then deflating and removing the void forming means.

BRIEF DESCRIPTION OF THE SEVERAL VIEWS OF THE DRAWING(S)

Reference will now be made to the accompanying drawings, which are not necessarily drawn to scale and which provide a non-limiting description of various embodiments, wherein:

FIG. 1 is a side elevation of an opened prior art slot drain;

FIG. 2 a cross-sectional view of the prior art slot drain of FIG. 1;

DETAILED DESCRIPTION OF VARIOUS EMBODIMENTS

Figure 1:
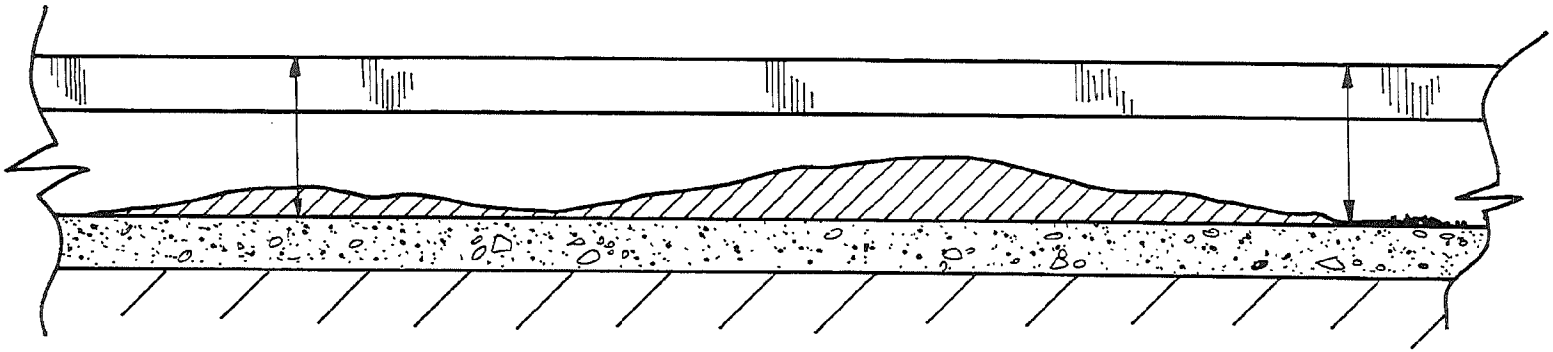

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

Referring to FIGS. 3 to 6, an assembly 10 for slipforming a slot drain with concrete is shown. The assembly 10 has a slipform paver 12, a movable sleeve, a void forming means and a taut tether. The movable sleeve is in the form of a cylindrical metal pipe 14 configured to fit over the void forming means which takes the form of a deflatable tube 16 being sealed at one end. During preparation, the tube 16 with the sealed end is laid in an excavated trench 18 in a deflated state, fed through the metal pipe 14 and then inflated.

Figure 4:
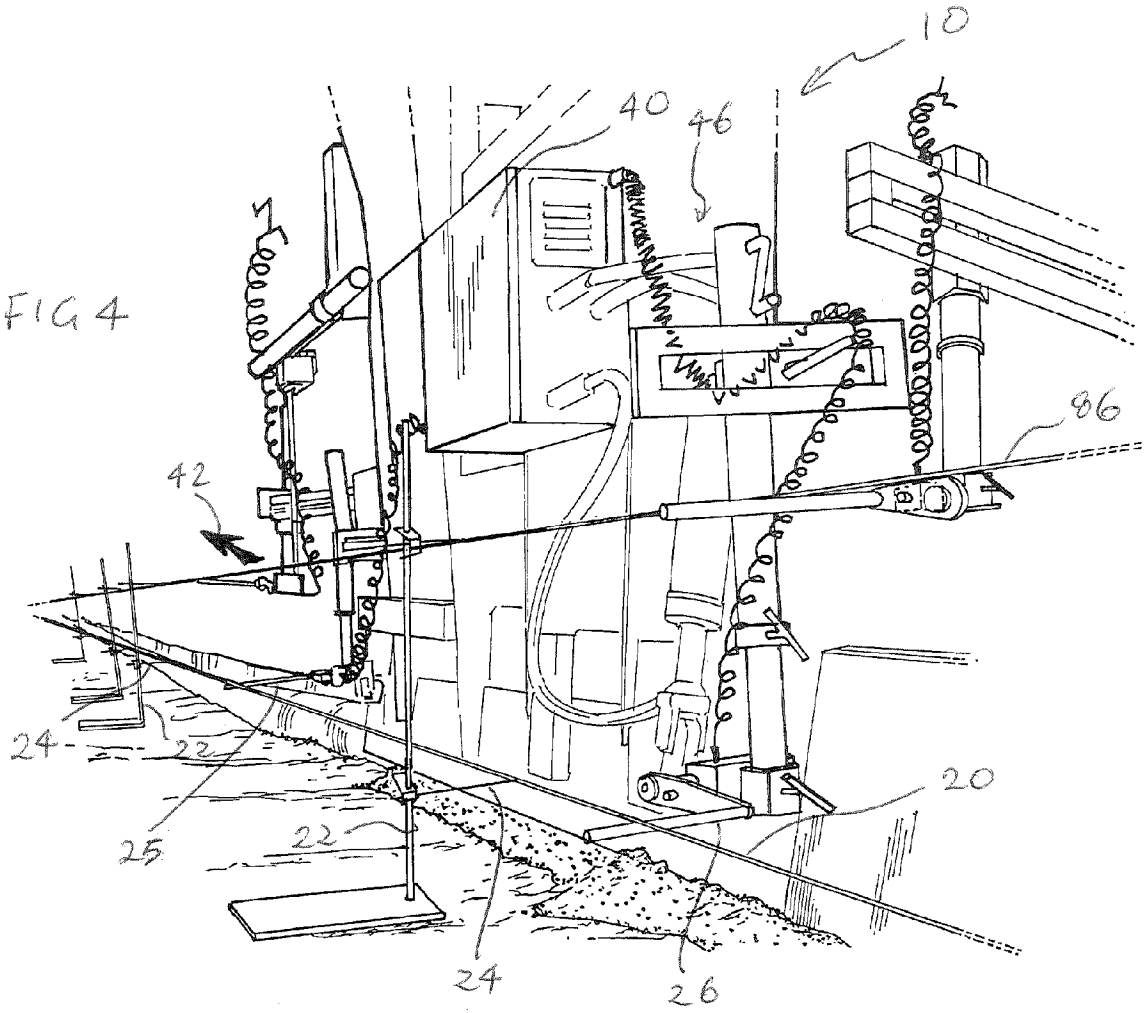
FIG. 4 is a side perspective view of the slipforming assembly of FIG. 3.
Figure 5:
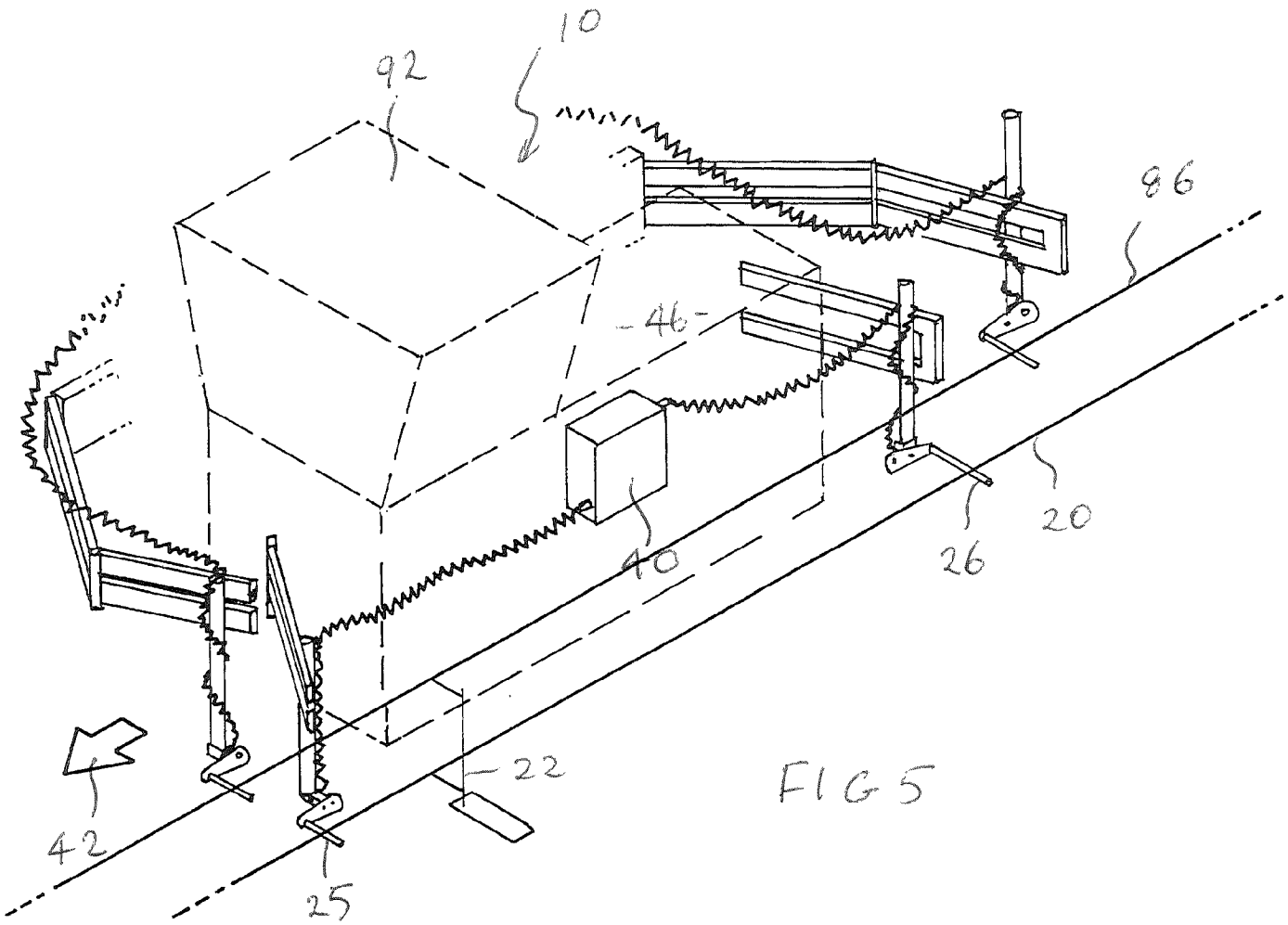
FIG. 5 is a schematic drawing illustrating the stringlines arrangement in the slipforming assembly of FIG. 1.

As best shown in FIGS. 4 and 5, the assembly 10 has a first taut tether in the form of a stringline 20 being held in place by a system of stakes 22 and fastening means such as clamping devices 24 alongside the excavated trench 18. The stringline may be made of wire, cable, woven nylon, polyethylene rope, or similar materials. In the present embodiment, the stringline 20 is provided and maintained in an inclined disposition to provide a parallel reference for guiding the metal pipe 14 which in use is driven forward by the slipform paver 12. It should be noted that the stringline 20 may be provided and maintained in a declined disposition as well, depending on the desired ultimate disposition of the slot drain and on the side of the excavated trench 18 on which the slipform paver 12 is located.

As shown in FIGS. 4 and 5, the assembly 10 also includes sensing means and two actuators. The sensing means are in the form of wands 25 & 26 designed to receive guidance from the inclined stringline 20 for dictating the elevations and dispositions of the metal pipe 14. The actuators are in the form of hydraulic rams which are connected to the metal pipe 14. The actuators are controlled by the sensing wands 24 to achieve the dictated elevations and dispositions of the metal pipe 14.

Figure 6:
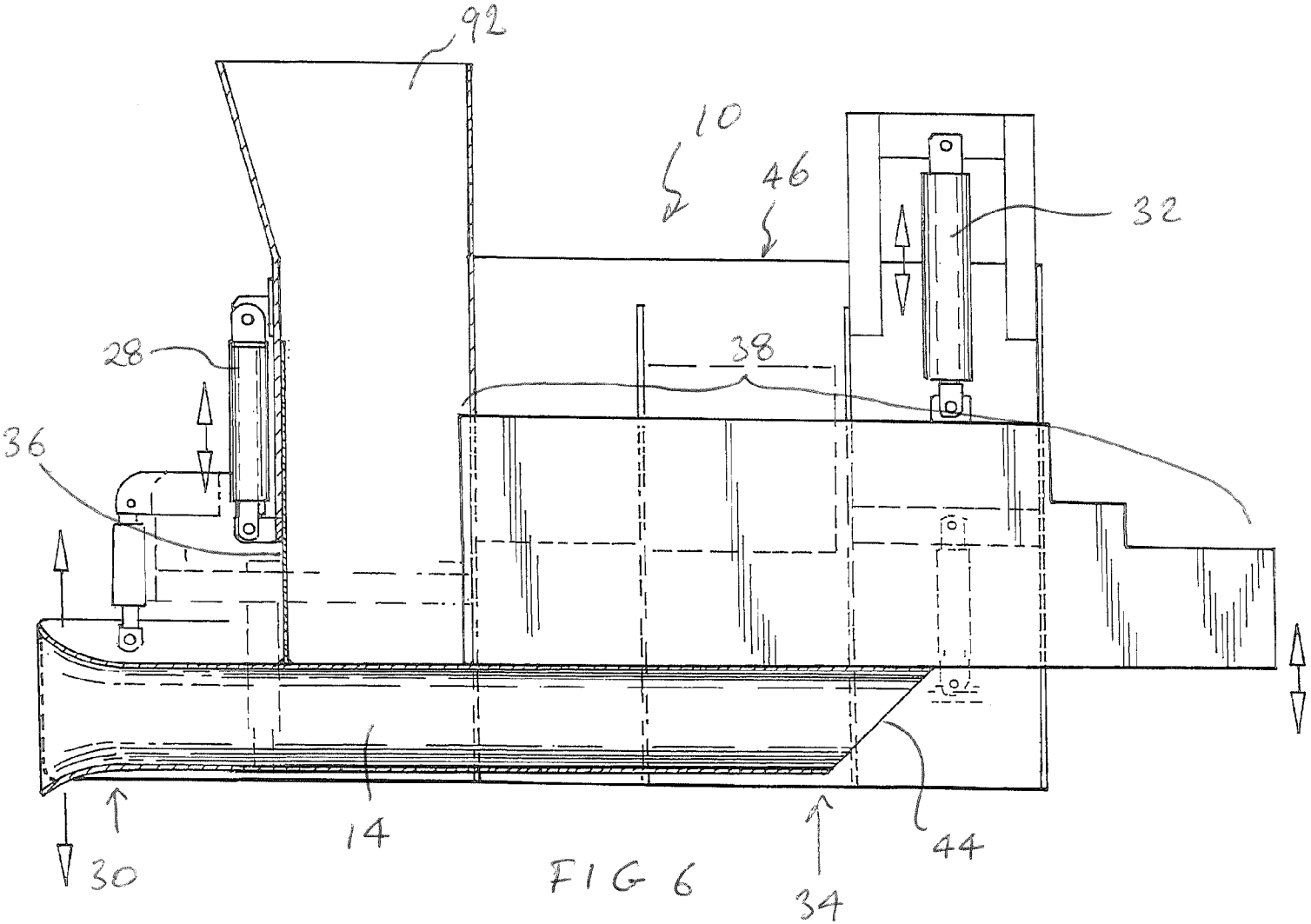
FIG. 6 is an internal side elevation of selected components of the slipforming assembly of FIG. 1 with the metal pipe being exposed.
Figure 8:
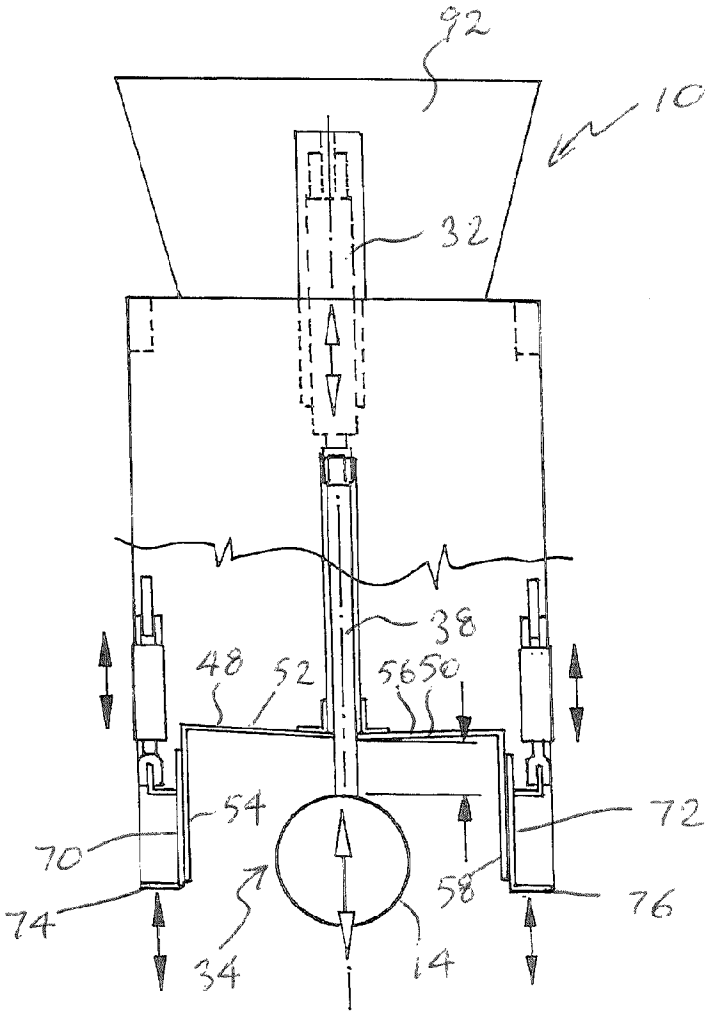
FIG. 8 is a rear end view of the slipforming assembly of FIG. 1.
Figure 7:
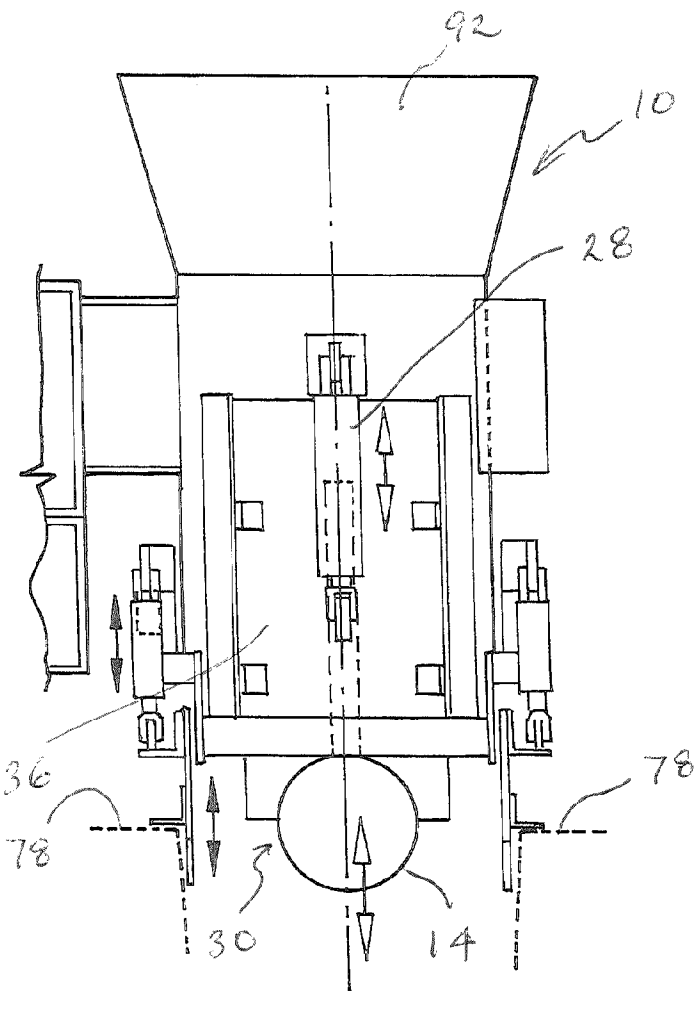
FIG. 7 is a front end view of the slipforming assembly of FIG. 1.

Referring to FIGS. 6 to 8, one of the actuators being a hydraulic ram 28 is associated with a first end 30 of the pipe 14 whereas the other actuator being another hydraulic ram 32 is associated with an opposite end 34 of the pipe 14. The hydraulic ram 28 is connected to a (first) connecting means being in the form of a plate 36. The hydraulic ram 28 is configured to actuate the plate 36 which is welded to the first end 30 of the pipe 14. The hydraulic ram 32 is also connected to a (second) connecting means which is also in the form of a plate 38. Part of the base of plate 38 is welded to almost half of the length of the pipe 14 covering the end 34. The hydraulic ram 32 is connected an upper part of the plate 38 and is capable of actuating the pipe 14 via the plate 38. In the present embodiment, the plates 36 & 38 are disposed perpendicular to one another and form part of a slipforming mould 46.

Figure 3:
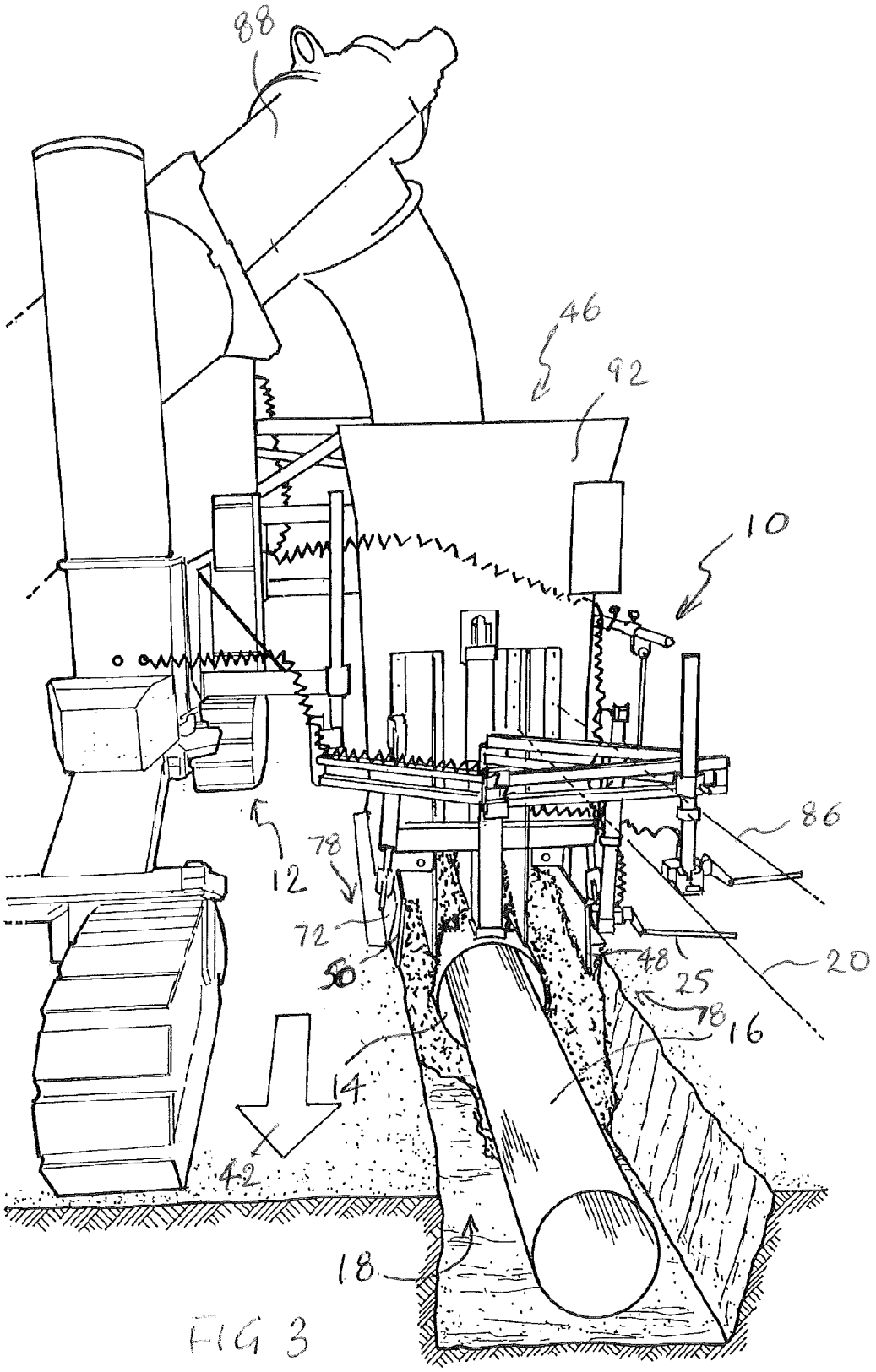
FIG. 3 is a front perspective view of a slipforming assembly in accordance with the present invention.

Turning to FIGS. 4 & 5, each of the sensing wands 25 & 26 is adapted to ride beneath the stringline 20 to receive guidance. Both sensing wands 25 & 26 are in electronic communication with a control means in the form of a box 40. The wands 25 & 26 are 20 capable of feeding signals to the control box 40 via an amplifier, which is built in the control box 40, to operate the hydraulic rams 28 & 32, respectively. It will be appreciated that the hydraulic rams 28 & 32 are synchronised to place and maintain the metal pipe 14 in the inclined disposition at a selected angle as it moves forward as indicated by arrow 42 as shown in FIGS. 3 to 5. As such, once slipforming is completed, the slot drain ends up with a change of fall from pit to pit.

As shown in FIG. 6, the metal pipe 14 has a chamfered end 44 configured to reduce the concrete load on the metal pipe 14 during dispensing of the concrete.

Figure 9:
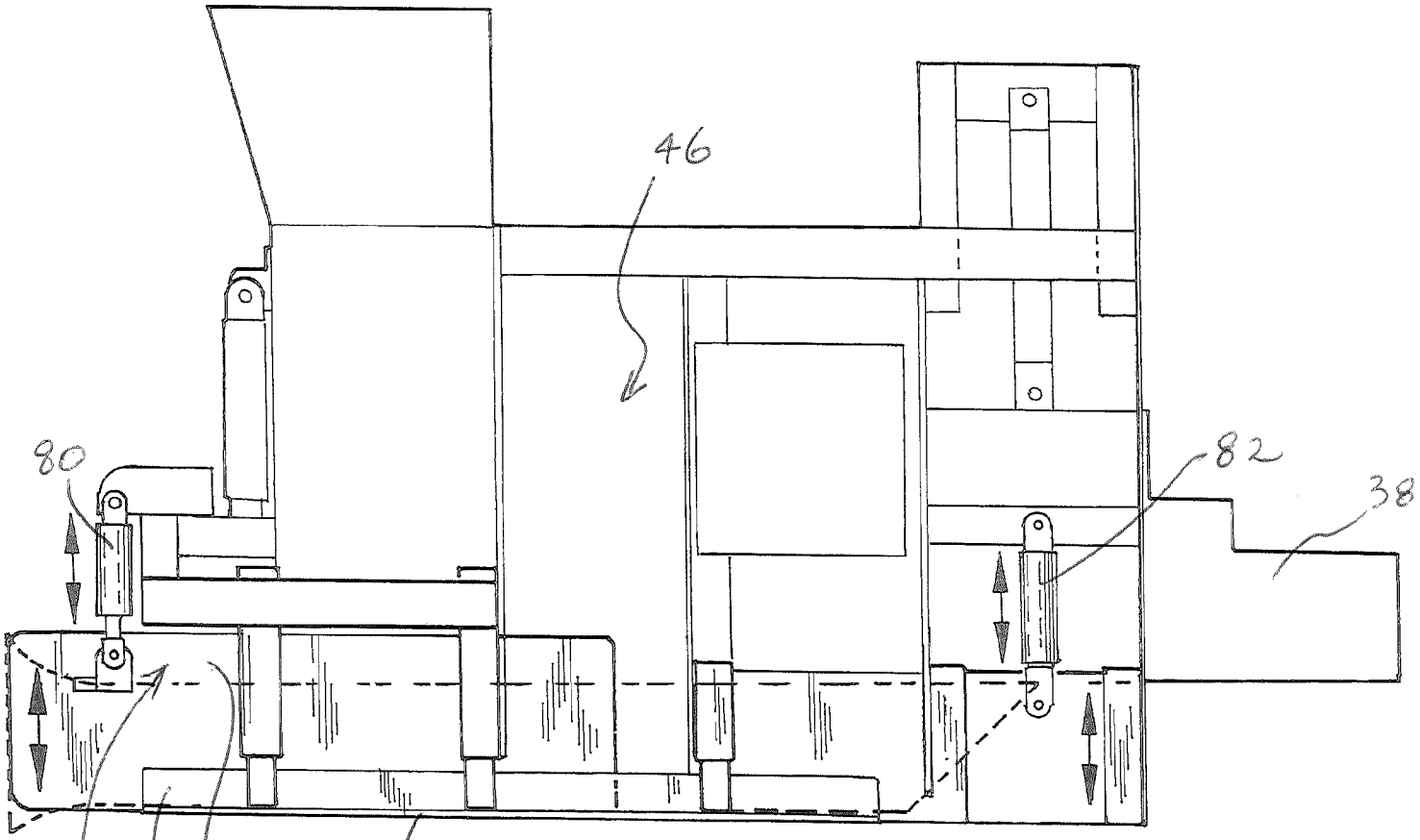
FIG. 9 is an external side elevation of selected components of the slipforming assembly of FIG. 1 with the metal pipe being concealed.
Figure 10:
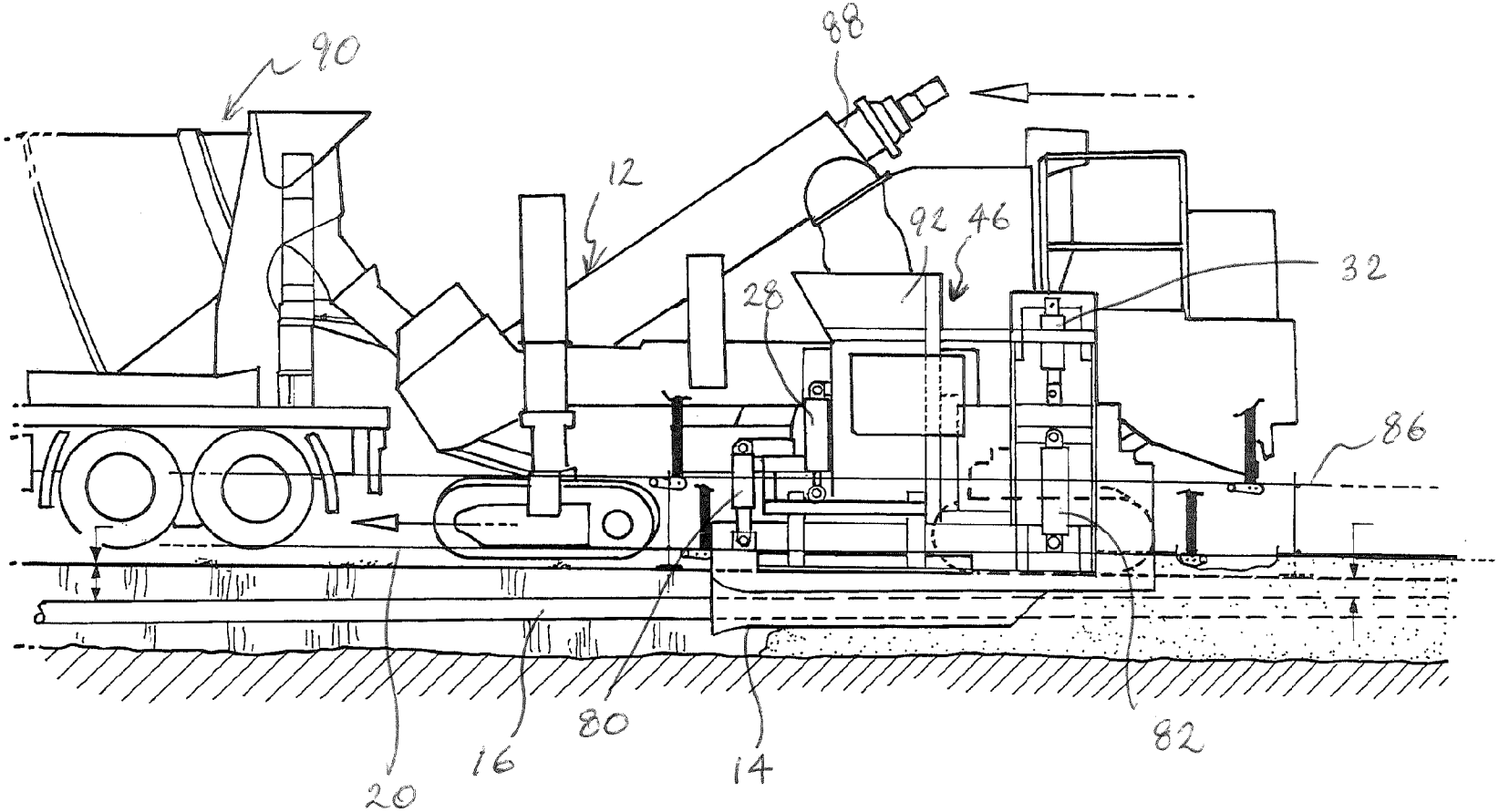
FIG. 10 is a side elevation of the slipforming assembly of FIG. 1 with the metal pipe exposed within the excavated trench.

Referring to FIGS. 9 and 10, the assembly 10 has a slipforming mould 46 which during operation is driven forward by the slipform paver 12. The slipforming mould 46 includes form guiding means which are in the form of a pair of substantially L-shaped elongate brackets 48 & 50. Each of the pair of L-shaped brackets 48, 50 has first and second limbs 52 & 54 and 56 & 58, as best shown in FIG. 8. Each first limb 52, 56 is transversely slanted so as to form the uppermost surface 60 (see FIG. 12) of the slot drain 62 capable of directing water flows towards the slipformed slot 64. Each of the second limbs 54 & 58 is substantially vertically placed. The elongate brackets 48 & 50 are provided and configured to define an upper portion 66 of the slot drain 62 to be slipformed. Once the slot drain 62 has been slipformed, the uppermost surface 60 of the upper portion 66 would form a longitudinally level road surface 68.

Figure 2:
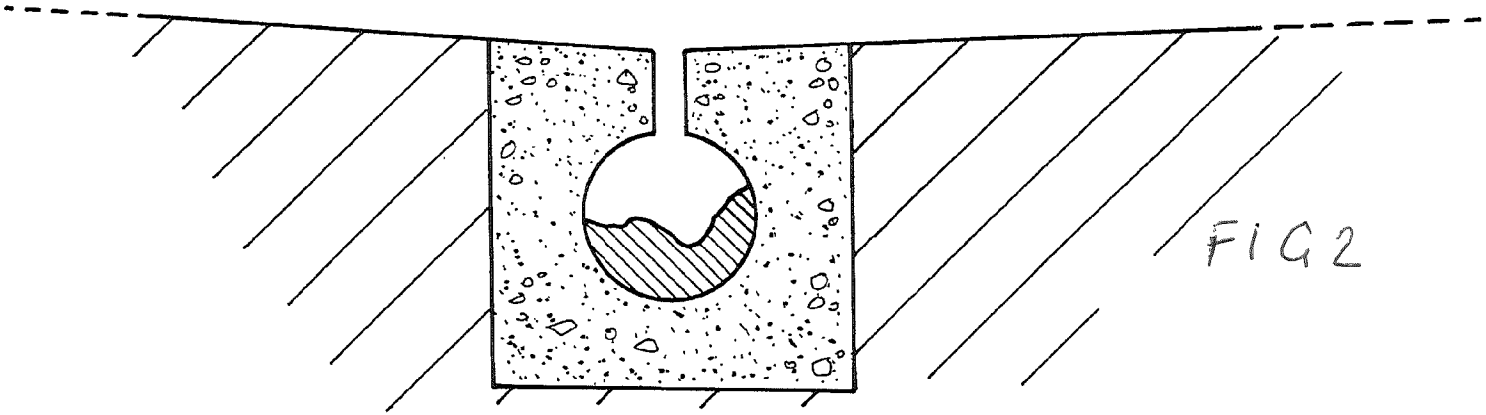

Turning to FIGS. 8 to 10, the assembly 10 also includes means adapted to allow the elongate brackets 48 & 50 to be adjustably placed at a desired level. The means are in the form of a pair of longitudinally elongate legs 70 & 72. Each leg 70, 72 has a foot 74, 76. Each leg 74, 76 is extendably connected to the corresponding second limb 54. 58 of each elongate bracket 48, 50. As such, the form guiding means being brackets 48, 50 may be adjusted to a higher level when the legs 70 and 72 are moved to the extended position. As best shown in FIG. 8, each leg 70, 72 is configured to be inwardly inclined so as to prevent excess concrete from escaping during slipforming. The foot 74, 76 of each leg 70, 72 is configured in use to rest on a base 78 (see FIGS. 2 and 7) alongside the trench 18. Each elongate leg is connected to an activator 80 & 82, for example. The activators 80 & 82 being in the form of hydraulic rams are provided and configured to allow manual control of the respective longitudinally elongate legs 70 & 72. In the present embodiment, the activators (80 & 82 for example) are provided towards the respective opposite ends of each longitudinally elongate leg 70, 72.

Referring to FIGS. 3, 4, 5 and 10, the assembly includes a second taut tether also in the form of a stringline 84. The stringline 84 is provided and maintained in a level disposition to provide a parallel reference for controlling the steering and elevation of the slipform paver 12 as it moves forward.

As shown in FIGS. 3 and 10, the slipform paver 12 includes a screw-type auger 88 and a number of vibrators (not visible being located inside the slipforming mould 46). During slipforming, air-entrained concrete is delivered from a truck mixer 90 to the slipforming mould 46 via the auger 88 mounted on the slipform paver 12. The concrete is filled through the top of a hopper 92 and dispensed through the bottom of the hopper 92 into the slipforming mould 46. The vibrators function to agitate the concrete so that it properly fills the slipforming mould 46. The vibrators also consolidate the agitated concrete.

Figure 11:
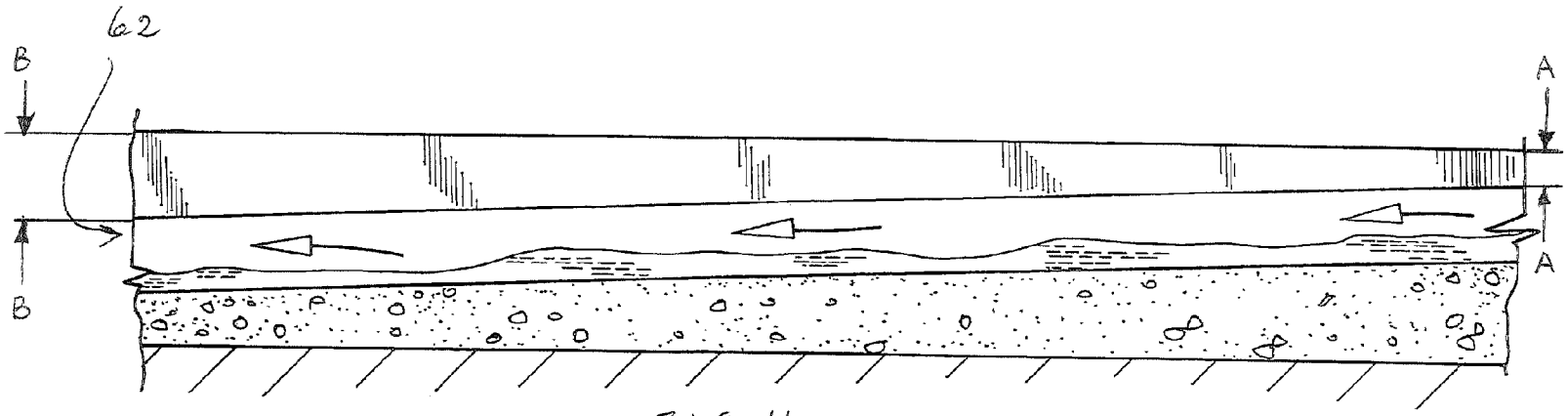
FIG. 11 is a side elevation of an opened and inclined slot drain formed by the slipforming assembly of FIG. 1.
Figure 12:
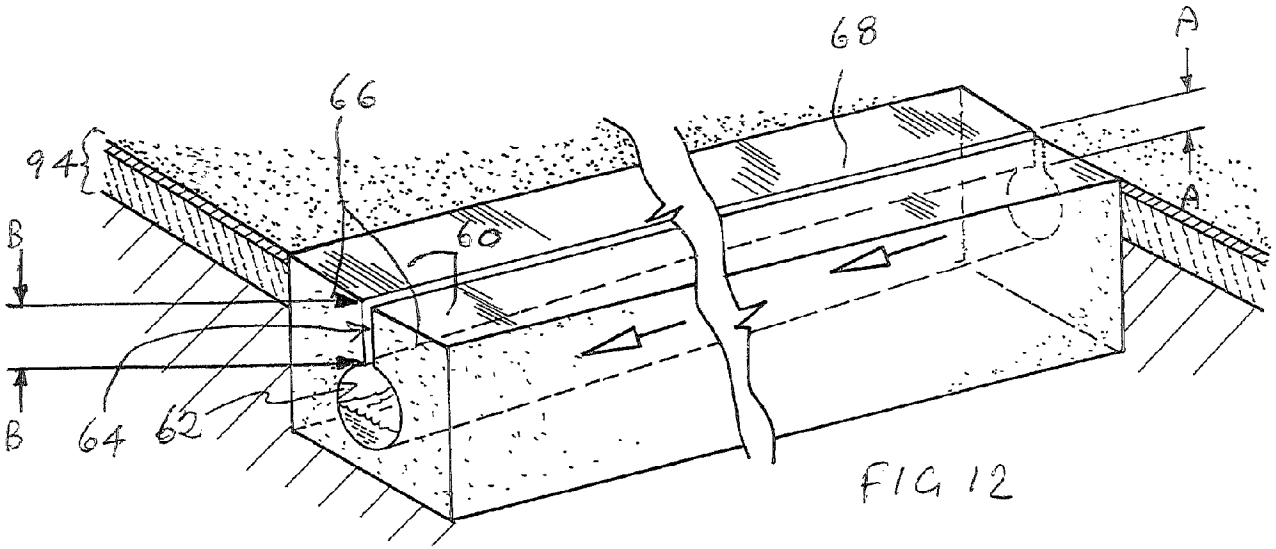
FIG. 12 is a perspective view of the slot drain of FIG. 11.

In operation, slipforming a slot drain with concrete using the method of the present invention involves the steps of providing the slipform paver 12, fitting the metal pipe 14 over a deflated tube 16, setting and maintaining the stringline 20 in an inclined (or declined if desired) position to provide a parallel reference for guiding the metal pipe 14 which in use is driven forward by the slipform paver 12. During operation, the sensing wands 25 & 26 receive guidance from the inclined stringline 20 thereby dictating the elevations and dispositions of the metal pipe 14 via the hydraulic rams 28 and 32. The sensing wands 25 & 26 are designed to feed signals to the control box 40 which in turn sends a signal to the hydraulic valve banks which control the oil flow in the hydraulic rams 28 & 32 in order to achieve the dictated elevations and dispositions 20 of the metal pipe 14. Forward movement of the slipform paver 12 causes the metal pipe 14 to move accordingly at a selected angle of inclination (or declination) along the excavated trench 18 whilst the concrete is dispensed from the slipforming mould 46. As shown in FIGS. 11 & 12, running the slipform paver 12 from pit to pit results in the slot drain 62 having a changing fall or rise. The last steps are to let the concrete set and 25 then deflate and remove the void forming means. After forming the slot drain 62, a layer of hot mix 94 (see FIG. 12) is then poured onto the base 78 such that the upper surface of the hot mix 94 and the uppermost surface 60 of the slot drain 62 are at grade.

It can be seen from FIGS. 11 & 12 that the distance between the road surface and the top of the drain at one end of the drain 62, indicated by arrows A-A, is significantly shorter than that indicated by arrows B-B at an opposite end. As such, the inclined slot drain 62 has the capability of self-cleaning with any dirt, leaves etc. being flushed towards the downstream pit by flowing rain water that naturally runs down the metal pipe 14 (as illustrated by the arrows shown in FIGS. 11 & 12) due to gravity.

Now that various embodiments of the present invention has been described in some detail, it will be apparent to a skilled person in the art that the slipforming assembly of the present invention may offer at least the following non-limiting and exemplary advantages: (1) it enables slipforming of slot drains that are capable of self-cleaning; and (2) it provides a cost effective way of producing low maintenance slot drains.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed herein. Indeed, modifications and other embodiments are intended to be included within the scope of the present invention. Additional details in this regard, related to those embodiments described herein and to still other embodiments may be further gleaned from the attached Appendix. In addition, although specific terms are employed herein, they are used in a generic and descriptive sense only and not for purposes of limitation.

The invention claimed is:

1. An assembly for slipforming a slot drain with concrete, the assembly comprising:

a slipform paver;

a movable sleeve adapted to fit over a void forming means;

a first taut tether provided and maintained in an inclined or declined disposition to provide a parallel reference for guiding the sleeve which in use is driven forward by the slipform paver;

sensing means adapted to receive guidance from the inclined or declined tether for dictating the elevations and dispositions of the sleeve; and one or more actuators connected to the sleeve and adapted to be controlled by the sensing means to achieve the dictated elevations and dispositions of the sleeve.

2. The assembly of claim 1, further comprising a slipforming mould configured to be driven forward by the slipform paver.

3. The assembly of claim 1, wherein the sleeve comprises a cylindrical pipe.

4. The assembly of claim 3, wherein the pipe has a chamfered end configured to reduce concrete load on the cylindrical pipe during dispensing of the concrete.

5. The assembly of claim 1, wherein the tether comprises a stringline held in place by a system of stakes and fastening means.

6. The assembly of claim 1, wherein said one or more actuators comprises first and second actuators, the first actuator being associated with a first end of the pipe, the second actuator being associated with a second end of the pipe.

7. The assembly of claim 6, wherein the first actuator is configured to actuate a first connecting means which is affixed to the first end of the pipe.

8. The assembly of claim 6, wherein the second actuator is configured to actuate a second connecting means which is affixed to the second end of the pipe.

9. The assembly of claim 1, wherein each of the first and second actuators is a hydraulic ram.

10. The assembly of claim 8, wherein the first and second connecting means are in the form of plates.

11. The assembly of claim 10, wherein the plates are disposed perpendicular to one another, each plate being at least one of connected to or forming part of the slipforming mould.

12. The assembly of claim 1, wherein the sensing means comprises first and second sensing wands, each wand configured to ride beneath the stringline to receive guidance.

13. The assembly of claim 12, wherein the first and second sensing wands are in electronic communication with a control means.

14. The assembly of claim 13, wherein the first and second wands are configured for feeding signals to the control means via an amplifier to operate the first and second actuators, respectively.

15. The assembly of claim 6, wherein the first and second actuators are synchronised to place and maintain the forward moving cylindrical pipe in the inclined or declined disposition at a selected angle.

16. The assembly of claim 2, wherein the slipforming mould includes form guiding means adapted to define an upper portion of the slot drain.

17. The assembly of claim 16, wherein an uppermost surface of the upper portion forms a longitudinally level road surface.

18. The assembly of claim 16, wherein the form guiding means are in the form of a pair of substantially L-shaped elongate brackets.

19. The assembly of claim 18, wherein each of the pair of L-shaped brackets comprises first and second limbs.

20. The assembly of claim 19, wherein each first limb is transversely slanted so as to form the uppermost surface capable of directing water flows towards the slipformed slot.

21. The assembly of claim 19, wherein each second limb is substantially vertically placed.

22. The assembly of claim 16, further comprising means configured to allow the form guiding means to be adjustably placed at a desired level.

23. The assembly of claim 22, wherein the means include a pair of longitudinally elongate legs, each leg having a foot.

24. The assembly of claim 23, wherein each leg is extendably connected to the corresponding second limb of each L-shaped bracket.

25. The assembly of claim 23, wherein each leg is configured to be inwardly inclined so as to prevent excess concrete from escaping during slipforming.

26. The assembly of claim 23, wherein the foot of each leg is configured in use to rest on a base alongside the trench.

27. The assembly of claim 23, which includes a pair of activators adapted to allow manual control of each longitudinally elongate leg.

28. The assembly of claim 27, wherein the activators are provided towards the opposite ends of the longitudinally elongate leg.

29. A method of slipforming a slot drain with concrete, the method including the steps of:

providing a slipform paver;

fitting a movable sleeve over a void forming means;

providing and maintaining a first taut tether in at least one of an inclined or declined disposition to provide a parallel reference for guiding the sleeve which in use is driven forward by the slipform paver;

providing sensing means adapted to receive guidance from at least one of the inclined or declined first tether for dictating the elevations and dispositions of the sleeve; and providing one or more actuators connected to the sleeve and adapted to be controlled by the sensing means to achieve the dictated elevations and dispositions of the sleeve.

30. The method of claim 29, further comprising the step of moving the slipform paver thereby causing the sleeve to move accordingly at a selected angle of inclination or declination along an excavated trench whilst the concrete is dispensed from a slipforming mould.

31. The method of claim 29, further comprising the step of running the slipform paver from pit to pit resulting in the slot drain having a changing fall or rise from pit to pit.

* * * * *